United States Patent [19]

Fox et al.

[11] Patent Number: 4,467,161

[45] Date of Patent: Aug. 21, 1984

[54] SWITCH APPARATUS

[75] Inventors: James W. Fox, Orland Park; Ronald J. Moery, Tinely Park, both of Ill.; Kenneth P. Banas, Munster, Ind.

[73] Assignee: G & W Electric Company, Blue Island, Ill.

[21] Appl. No.: 440,612

[22] Filed: Nov. 10, 1982

[51] Int. Cl.[3] ..... H01H 9/00

[52] U.S. Cl. ..... 200/281; 200/48 KB; 200/272; 200/162; 339/28

[58] Field of Search ..... 200/281, 280, 282, 275, 200/48 R, 48 KB, 271, 272, 293, 15, 162, 164 R; 339/276 T, 28, 29 R

[56] References Cited

U.S. PATENT DOCUMENTS

| | | | |
|---|---|---|---|
| 1,811,252 | 6/1931 | Ball | 200/15 |
| 1,887,742 | 11/1932 | Van Slunter | 200/15 |
| 2,519,855 | 8/1950 | Schleicher | 200/281 X |
| 2,596,983 | 5/1952 | Christensen | 200/281 X |
| 2,721,986 | 10/1955 | Badeau | 339/276 T |
| 3,330,919 | 7/1967 | Kovats | 200/42 R |
| 3,403,565 | 10/1968 | Kovats | 74/97 |
| 3,478,185 | 10/1969 | Perkins et al. | 200/254 |
| 3,519,970 | 7/1970 | Swanson et al. | 337/5 |
| 3,959,616 | 5/1976 | Swanson et al. | 200/254 |
| 3,973,823 | 8/1976 | Stanbeck et al. | 339/276 T |
| 4,061,896 | 12/1977 | Clancy et al. | 200/323 |
| 4,095,065 | 6/1978 | Akers | 200/63 R |
| 4,118,097 | 10/1978 | Budnick | 339/276 T X |
| 4,394,533 | 7/1983 | Naito | 339/276 T X |

FOREIGN PATENT DOCUMENTS

| | | | |
|---|---|---|---|
| 511473 | 10/1930 | Fed. Rep. of Germany | 339/29 R |
| 39083 | 3/1979 | Japan | 339/29 R |
| 142199 | 4/1920 | United Kingdom | 200/281 |

*Primary Examiner*—Stephen Marcus
*Assistant Examiner*—Ernest G. Cusick
*Attorney, Agent, or Firm*—Fitch, Even, Tabin & Flannery

[57] ABSTRACT

A high voltage multi-position type three phase electrical switch having stationary and movable contacts which are supported, respectively, on relatively fixed and movable contact supports internally of a switch casing. The contact supports are interchangeable and are made of a nonconductive molded plastic. The contact supports are adapted to selectively support either conductive contact support bars on which relatively stationary spring contacts are mounted, or contact blades which, in association with movement of a movable contact support, may be closed into spring contacts carried on an associated relatively fixed contact support. The movable contact blades comprise flexible braided electrical conductors having conductive contact sleeves swaged on their opposite ends so that the contact end portions define contact bars which are substantially solid in transverse cross section. In a two-position embodiment, the contact bar ends of each contact blade are adapted, respectively, for fixed connection to the bushing connectors of service entrance terminals and for movement into closed circuit with corresponding spring contacts mounted on the fixed contact support. In a three-position embodiment, a third molded contact support is fixed within the casing and has similar contacts associated therewith to enable closed circuit connection of alternative service entrance terminals.

8 Claims, 13 Drawing Figures

SWITCH APPARATUS

BACKGROUND OF THE INVENTION

The present invention relates generally to electrical switch apparatus, and more particularly to a high voltage multi-position switch having novel switch contacts and interchangeable contact supports.

High voltage multi-position switches, and particularly such switches employing means for effecting snap-action movement of switch contacts to obtain both load interruption and close into fault operation, are generally known. See, for example, U.S. Pat. Nos. 3,330,919, 3,403,565, 3,519,970, 3,959,616 and 4,095,065, all of which are assigned to the assignee of the present invention. These high voltage multi-position switches can generally be characterized as having a casing in which one or more sets or banks of movable switch contacts are mounted and which, in the case of two position switches, are movable between closed circuit and open circuit conditions. In the case of three position switches, the movable switch contacts are movable between either of two closed contact positions and a neutral or open circuit condition.

In the switches disclosed in U.S. Pat. Nos. 3,478,185, 3,959,616 and 4,095,065, the movable contacts take the form of bifurcated conductive contact supports having pairs of spring contacts mounted on their bifurcated ends to receive fixed switch contact blades when in closed circuit relation. The bifurcated contact supports are mounted on nonconductive rocker arms or plates and have their ends opposite the bifurcated ends connected through bolt clamps and associated braid connectors to bushing conductors defining switch service entrances. The fixed or stationary contact bars are similarly connected to a bus bar and associated bushing conductors through braid conductors and associated bolt clamps and the like. While the rocker arms or plates of the type employed in the aforementioned patents to support the movable contacts have proven relatively satisfactory in operation, they do not readily lend themselves for use in selective interchangeable support of both fixed and movable contacts so that different types of contact supports are required for the fixed and movable switch contacts. Further, the braid conductors and associated bolt clamp connections as have heretofore been employed in high voltage switches are relatively labor intensive thereby contributing significantly to the cost of manufacture.

SUMMARY OF THE INVENTION

In accordance with the present invention, a high voltage polyphase type multi-position switch is provided having relatively movable and stationary switch contacts mounted, respectively, on interchangeable nonconductive contact supports which are preferably made from a molded plastic. The interchangeable contact supports are adapted for mounting either movable contact blades or stationary spring contacts thereon and have mounting pads and flanges formed on their opposite ends which enable fixed mounting on a frame structure, in the case of supporting spring contacts, or connection to a fast-action transfer mechanism, in the case of supporting contact blades for movement between closed circuit and open circuit positions relative to stationary spring contacts. The contact blades in accordance with the invention comprise flexible stranded electrical conductor cables having conductive contact sleeves swaged on their opposite ends so as to form substantially solid contact end portions one of which is adapted for fixed electrical connection to a bushing connector or the like, and the other of which is adapted for mounting on an associated contact support for movement into closed circuit relation with stationary spring contacts.

In a three position switch embodiment, an identical shaped third molded contact support is fixed within the switch casing and has relatively stationary spring contacts mounted on similar swaged type contact support blades which facilitate connection to external bushing connectors. The contact blades in accordance with the invention eliminate the use of separate contact bars and bolt clamps to secure the contact bars to the opposite ends of stranded conductor cables as have heretofore been employed in high voltage switches.

Accordingly, one of the primary objects of the present invention is to provide a high voltage switch having improved contact blades which eliminate the need for bolt clamps as have heretofore been required.

Another object of the present invention is to provide a high voltage multi-position polyphase switch having interchangeable contact supports adapted to support either movable contact blades or stationary spring contacts.

A feature of the invention lies in the provision of contact blades comprising flexible stranded electrical conductors having conductive contact sleeves swaged on their opposite ends so that the contact end portions are substantially solid in transverse cross section and have generally planar oppositely facing current carrying surfaces.

Another feature of the invention lies in the provision of interchangeable contact supports which are made from a molded nonconductive plastic material and which have mounting pads formed in longitudinally spaced relation along the supports and have mounting flanges formed on their opposite ends to enable mounting in stationary relation on a fixed frame structure, or connection to a switch transfer mechanism opearative to move associated contact blades into and out of closed circuit relation with stationary spring contacts.

Further objects, advantages and features of the present invention, together with the organization and manner of operation thereof, will become apparent from the following detailed description of the invention when taken in conjunction with the accompanying drawings wherein like reference numerals designate like elements throughout the several views.

DETAILED DESCRIPTION OF PREFFERRED EMBODIMENTS

Figure 1:
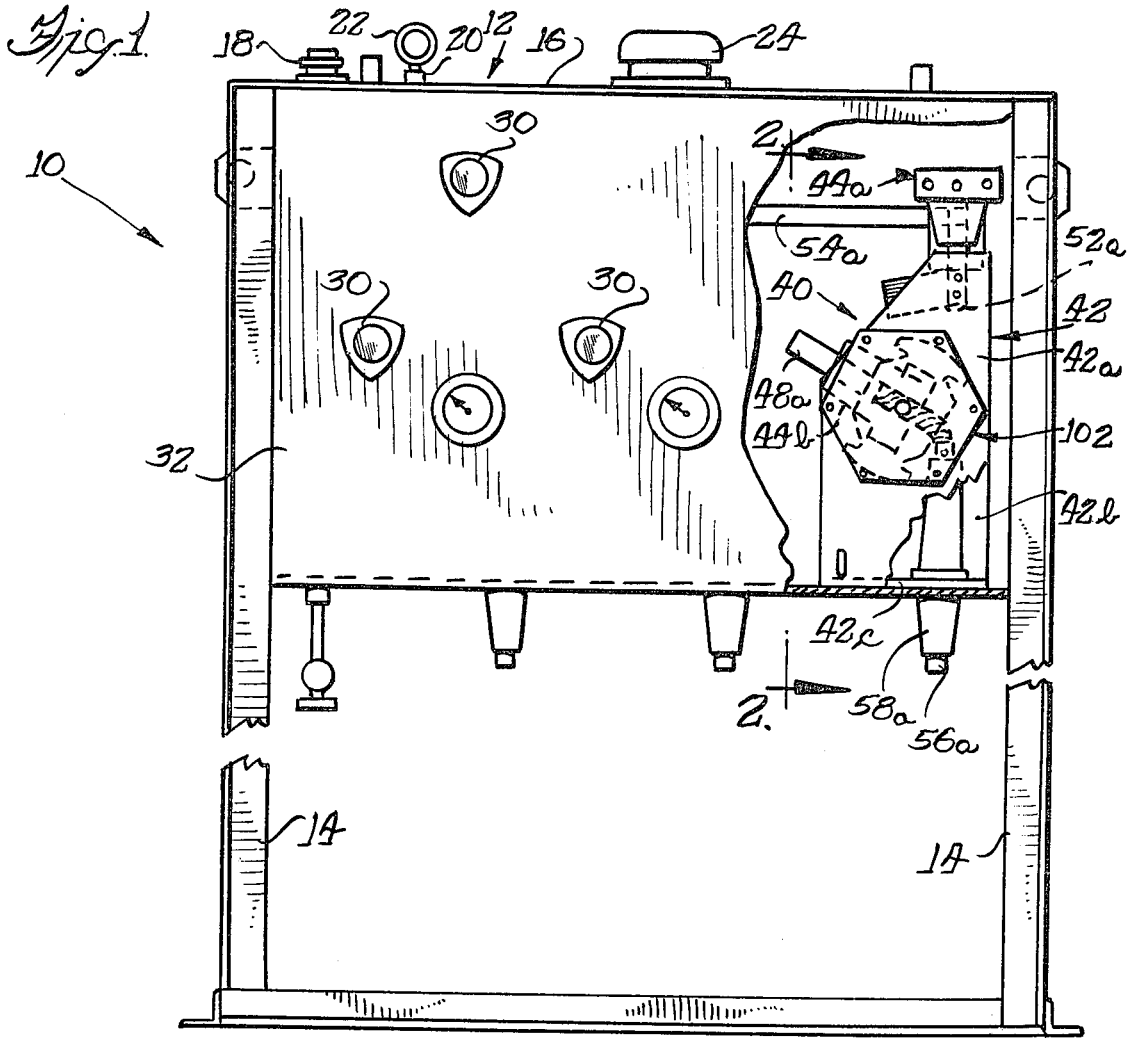
FIG. 1 is a front elevational view of a high voltage multi-position switch embodying switch contact blades and interchangeable contact supports in accordance with the present invention, a portion of the switch casing being broken away to illustrate an internal switch module.

Referring now to the drawings, and in particular to FIG. 1, the present invention is illustrated, by way of example, as being embodied in a high voltage multiposition polyphase switch, indicated generally at 10. By high voltage is meant a voltage of approximately 15 KV having an impulse level rating of approximately 110 KV and continuous and interrupting current ratings of approximately 600 amps. The high voltage switch 10 includes a generally rectangularly shaped fluid tight casing 12 which may be mounted on upstanding support legs 14 as is known. The casing 12 has a removable top cover plate 16 having a fill plug 18 which facilitates filling of the casing 12 with a suitable dielectric insulating medium such as transformer oil, askerel, silicon fluid or dielectric grade insulating gases such as sulphur-hexaflouride (SF6). A conventional gas test plug 20 and associated pressure gage 22 may also be mounted on the upper cover plate 16 along with a pressure relief device 24. A drain valve 26 is preferably mounted on a bottom wall 28 of the casing 12 for drain and sampling purposes. A plurality of oil sight or viewing windows 30 are preferably mounted on a front wall 32 of casing 12 to facilitate visual detection of the level of dielectric within the casing 12.

Figures 2, 3:
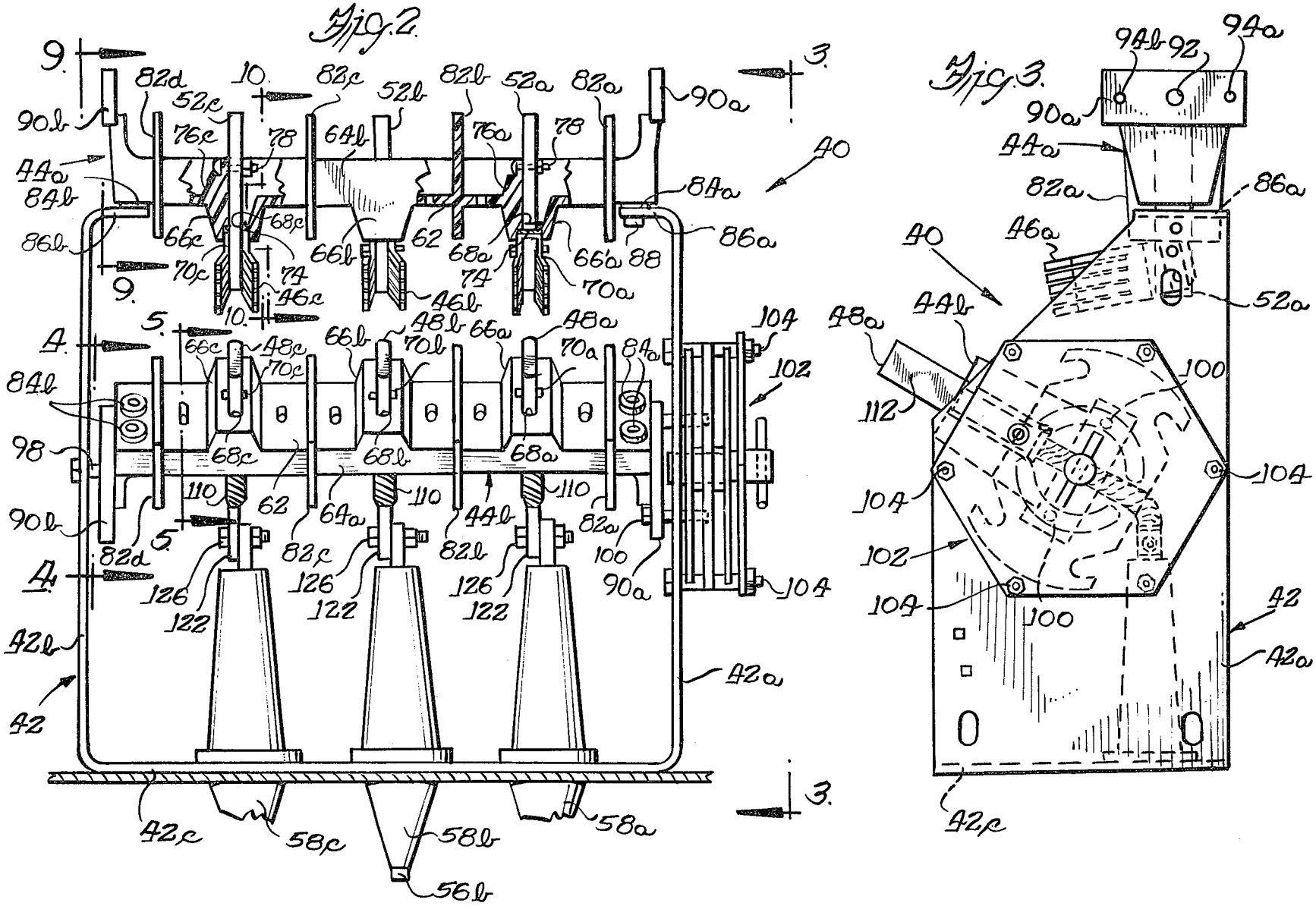
FIG. 2 is a front view of the two position switch module shown in FIG. 1, taken substantially along line 2—2 of FIG. 1 looking in the direction of the arrows, with portions of the contact support being broken away for clarity.
FIG. 3 is an end view of the two position switch module shown in FIG. 2, taken substantially along line 3—3 of FIG. 2.
Figure 4:
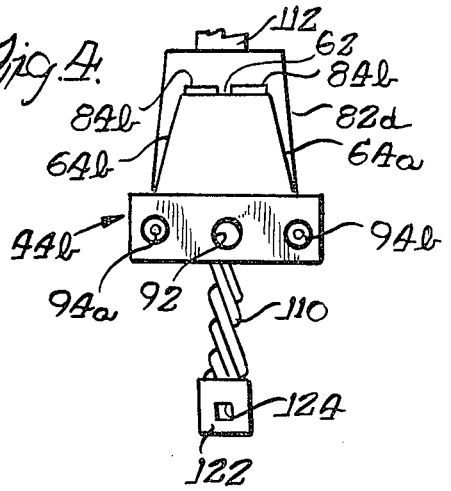
FIG. 4 is an end view of the movable contact support, taken substantially along line 4—4 of FIG. 2 but with the support shown in a generally vertical orientiation.
Figure 5:
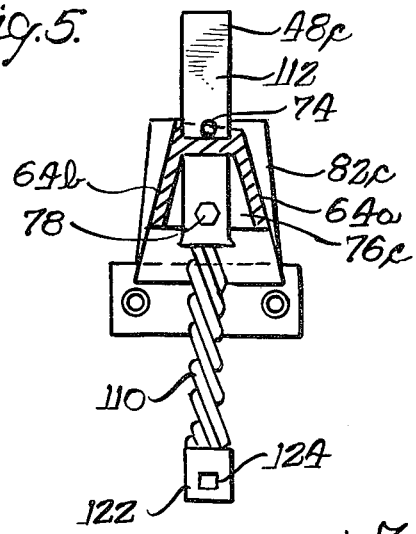
FIG. 5 is a fragmentary transverse sectional view taken substantially along line 5—5 of FIG. 2 but with the contact support oriented so that the associated contact blades extend substantially vertically.

In the embodiment illustrated in FIG. 1, the switch 10 includes three substantially identical two-position switch mechanism modules, one of which is shown generally at 40, mounted within the casing 12. Each switch module 40 includes a housing or support frame 42 which is generally U-shaped so as to define upstanding parallel side plates 42*a* and 42*b* interconnected by an integral base or web plate 42*c*, as best seen in FIG. 2. Supported by and between the upstanding side plates 42*a,b* of each switch module are a pair of identically shaped contact support members 44*a* and 44*b*. Contact support member 44*a* serves to support three pairs of stationary spring type contacts, indicated at 46*a,b* and *c* in FIG. 2. Contact support member 44*b* serves as a movable contact support operative to support and move three movable contact blades, indicated at 48*a,b* and *c* in FIG. 2, between open and closed circuit positions relative to corresponding pairs of the fixed or stationary spring contacts 46*a,b* and *c*. The pairs or sets of spring contacts 46*a–c* are of known design and are mounted on associated stationary contact support bars 52*a,b* and *c*, respectively, which are of substantially identical transverse cross sectional configuration to the contact blades 48*a–c* and are supported by the stationary contact support 44*a*. The support bars are electrically connected, respectively, by separate bus bars, one of which is indicated at 54*a* in FIG. 1, to a corresponding phase set of fixed spring contacts on the next adjacent switch modular within the casing 12. Each of the movable switch contact blades 48*a,b* and *c* of each phase is connected to an associated service entrance bushing which may be of the type having a conductor terminal indicated at 56*a,b* and *c* in FIG. 2, mounted within a corresponding insulator bushing 58*a,b* and *c*, fixed within a suitable opening in the bottom wall 28 of the casing 12 in sealed relation therein, as is known.

In accordance with one feature of the present invention, the contact support members 44*a* and 44*b* are made of an electrically nonconductive material and are of identical construction enabling the contact support members to be employed as either the fixed spring contact support member 44*a* or the movable contact blade support member 44*b*. The contact support members 44*a* and 44*b* may be made of a suitable plastic, such as a glass reinforced polyester, which lends itself to molding of the contact support members. Referring particularly to FIG. 2, taken in conjunction with FIGS. 4, 5, 9 and 10, each of the contact supports 44*a,b* includes a longitudinal generally planar wall 62 formed integral with outwardly inclined sidewalls 64*a* and 64*b*. Each of the contact support members 44*a,b* has three equal size mounting pads 66*a*, 66*b* and 66*c* formed in substantially equidistantly spaced relation along the length of the longitudinal wall 62 and extending outwardly therefrom as illustrated in FIG. 2. In the illustrated embodiment, the mounting pad 66*b* is formed centrally along the length of the contact support member and the mounting pads 66*a* and 66*c* are formed substantially equidistantly between the center mounting pad 66*b* and their corresponding ends of the contact support member.

Each of the mounting pads 66*a,b* and *c* has an opening 68*a,b* and *c*, respectively, formed through its outermost planar surface of a configuration enabling snug insertion of either a movable contact blade 48*a,b* or *c* or a fixed spring contact support bar 52*a,b* or *c*. A recess or slot 70*a,b* and *c* is formed in the outermost surface of each mounting pad 66*a–c* so as to transversely intersect the associated opening 68*a–c* at approximately its midpoint. Each of the transverse recesses 70*a,b* and *c* serves to receive a cylindrical retainer pin 74 mounted transversely within the corresponding contact blades 48*a–c* or support bars 52*a–c*.

The mounting pads 66*a–c* are formed with transverse webs between the side walls 64*a,b*, as indicated at 76*a* and 76*c* in FIG. 2, to facilitate mounting of the associated contact blades 48*a–c* and support bars 52*a–c* as by bolts 78 received through suitable aligned openings in the webs 76*a* and 76*c* and the corresponding contact blades and support bars, it being understood that a similar transverse web is formed integral with the mounting pads 66*a–c* by the pins 74 and bolts 78.

A plurality of barrier surface plates are formed along the length of each of the contact support members 44*a,b* so as to extend transversely of the longitudinal axis of the contact support members, there being four such barrier surface plates 82*a,b,c* and *d* formed integral on the illustrated support members so as to lie substantially equidistantly between the mounting pads 64*a,b* and *c*, and between the mounting pads 64*a* and 64*c* and the corresponding ends of the support members, as shown in FIG. 2. The barrier surface plates 82*a–d* are generally planar and serve to increase the electrical surface length between the contact blades 48*a–c* and support bars 52*a–c* and associated spring contacts when mounted on the contact support members.

Each of the contact support members 44*a* and 44*b* has its opposite ends formed to enable mounting of the contact support as a fixed contact support or as a movable contact support within the switch module 40. To this end, the opposite ends of the contact support members 44*a,b* have pairs of outwardly extending mounting bosses 84*a* and 84*b* formed thereon so as to extend outwardly from the longitudinal wall 62 in symmetrical relation to its longitudinal center. The mounting bosses 84*a* and 84*b* have cylindrical bores formed centrally therethrough to facilitate mounting of the contact support members as fixed contact supports on upper flange portions 86*a* and 86*b*, respectively, of the upstanding walls 42*a* and 42*b* of the switch housing by suitable screws 88.

To facilitate mounting of either of the contact support members 44*a,b* internally of the switch module for use as a movable contact support, each of the contact supports has a mounting flange formed on each of its opposite ends as indicated at 90*a* and 90*b* in FIG. 2. The mounting flanges 90*a* and 90*b* are generally rectangular and each has a central circular opening or bore 92 formed therethrough and a pair of laterally spaced smaller diameter openings 94*a* and 94*b* the centers of which lie on a straight line intersecting the center of opening 92 and parallel to the longitudinal wall 62. In mounting a contact support member 44*a* or 44*b* as the movable contact support member within the switch module 40, one end is pivotally mounted on a pivot stub shaft 98 which is fixed to the upstanding sidewall 42*b* in normal relation thereto and received within the central opening 92 in the corresponding mounting flange 90*b*. The opposite mounting flange 90*a* is connected through a pair of screws 100 to a snap-action switch transfer mechanism, indicated generally at 102, mounted on the outer surface of the upstanding wall 42*a* of the switch module through mounting bolts 104. The screws 102 are received through the cylindrical openings 94*a,b* in the associated mounting flanges 90*a*.

The snap-action switch actuator mechanism 102 is of known construction such as disclosed in U.S. Pat. No. 3,403,565 to W. S. Kovats which is incorporated herein by reference. The switch actuator mechanism 102, per se, forms no part of the present invention and exemplifies one of a number of known switch actuator mechanisms which could be employed to effect snap-action movement of the movable contact support member 44*b* from a position wherein the contact blades 48*a–c* are spaced from their corresponding spring contacts 46*a–c* and a position wherein the contact blades are in electrically conductive relation with the associated spring contacts.

Figure 6:
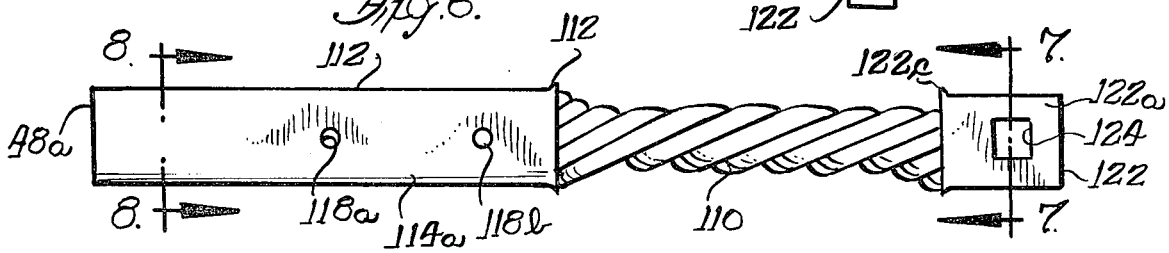
FIG. 6 is a side view of a contact blade representative of the movable contact blades employed in the two position switch module of FIGS. 2 and 3.
Figure 7:
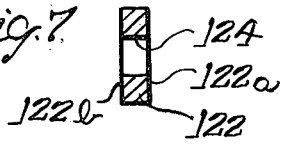
FIG. 7 is a transverse sectional view taken substantially along line 7—7 of FIG. 6.
Figure 8:
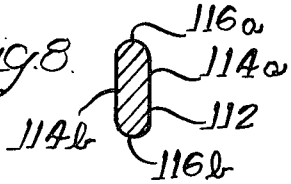
FIG. 8 is transverse sectional view taken substantially along line 8—8 of FIG. 6.
Figure 9:
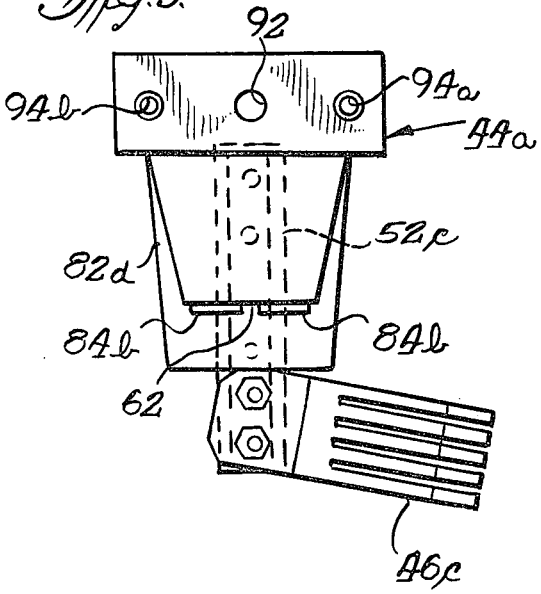
FIG. 9 is an end view, on an enlarged scale, of the stationary contact support and associated spring contact of FIG. 2, taken substantially along line 9—9 of FIG. 2.
Figure 10:
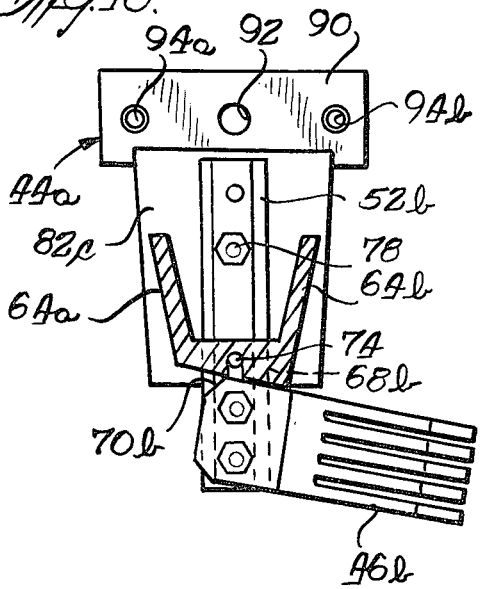
FIG. 10 is a fragmentary transverse sectional view through the stationary contact support, taken substantially along line 10—10 of FIG. 2.

In accordance with another feature of the present invention, and with particular reference to FIGS. 6–8, each of the contact blades 48*a–c* includes a length of helically stranded flexible electrically conductive cable 110 having a first conductive sleeve 112 coaxial over one end and swaged thereto with a swaging force sufficient to form a contact end having a substantially unified solid transverse cross section as illustrated in FIG. 8. The conductive sleeve 112 may be formed of a suitable conductive copper alloy and is initially positioned as a generally cylindrical sleeve coaxially over an end of the conductor cable 110 and is then swaged thereon so as to effect cold flow of the conductor cable with the conductive sleeve to establish the substantially solid cross-sectional contact blade of FIG. 8.

Swaging of the conductive sleeve 112 onto the conductor cable is effected such that substantially parallel flat current carrying surfaces 114*a* and 114*b* are formed on the swaged sleeve 112 to establish a predetermined thickness in relation to the conductive spring contacts 46*a–c* with which the contact blade is to be employed. The opposite planar side surfaces 114*a,b* of the swaged contact end 112 are preferably interconnected through uniformly curved or rounded edge surfaces 116*a* and 116*b* to reduce arcing between the current carrying contact surfaces 114*a,b* and thereby substantially prevent deterioration of the flat current carrying surfaces. The edge surfaces 116*a,b* may, however, be made flat if desired. Transverse cylindrical bores 118*a* and 118*b* are formed through the contact ends 112 so that their centers lie on the longitudinal centerlines of the contact ends, the bores 118*a,b* being adapted to receive a retainer pin 74 and mounting bolt 78, respectively, for securing the swaged contact ends 112 of the contact blades 48*a–c* to the corresponding mounting pads 66*a–c* on the contact blade support member 44*a* or 44*b* selected as the movable contact blade support.

The ends of the flexible conductor cables 110 opposite the associated swaged conductive sleeves 112 have shorter length conductive sleeves 122 swaged thereon so as to form connector ends having parallel planar side surfaces 122*a,b*. The sleeves 122 may also be made of a suitable conductive copper alloy and are swaged onto the corresponding flexible conductor cables 110 with sufficient force to effect cold flow between the adjacent strands of the conductor cable and between the cable strands and the conductive sleeve 122. In this manner, a substantially unified solid transverse connector end 122 is formed as shown in FIG. 7. A square opening or bore 124 is formed in each cable connector end 122 to facilitate connection to the upper end of a corresponding bushing conductor, such as 56*a–c*, within the casing 12 through a bolt 126, as shown in FIG. 1.

In swaging the conductive sleeves 112 and 122 onto the opposite ends of the conductor cable 110, the opposed ends of the conductive sleeves 112 and 122 may be formed with circumferential flairings, as indicated at 112*a* and 122*c*, having radii which preferably do not exceed approximately 0.125 inch.

Figure 12:
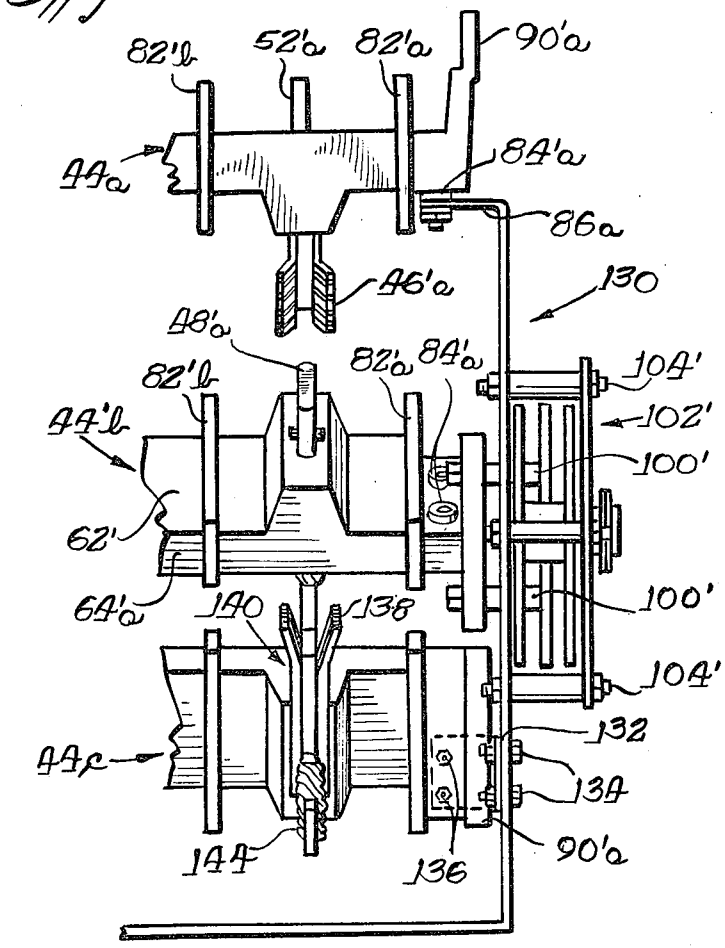
FIG. 12 is a fragmentary front view of the switch shown in FIG. 11.
Figure 11:
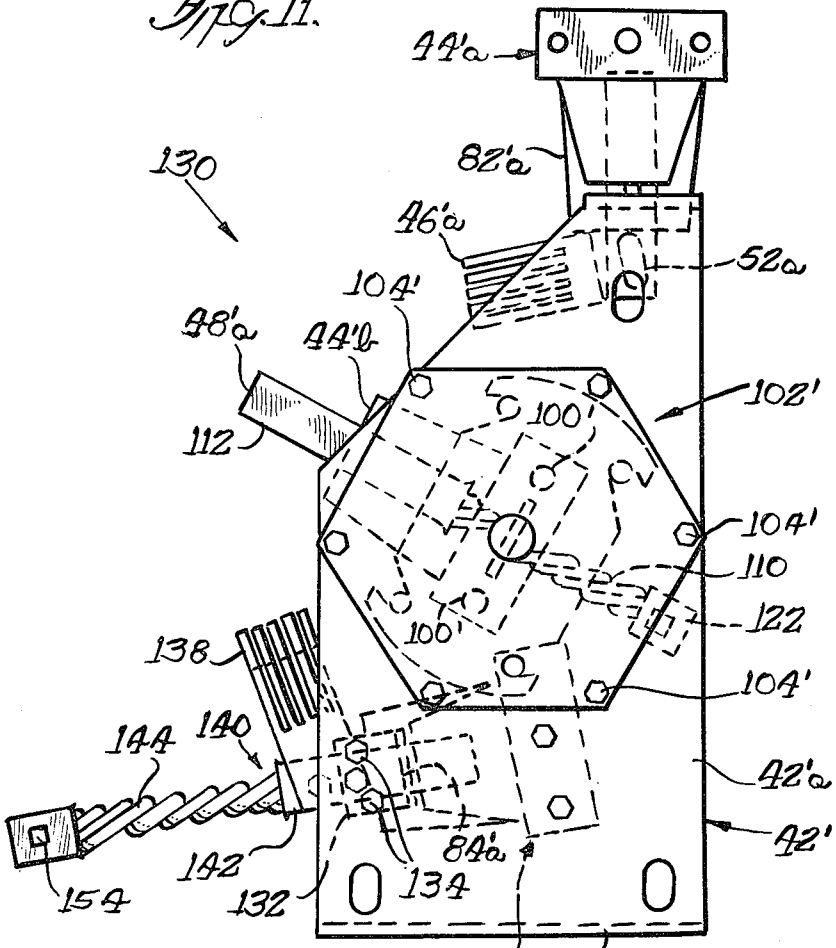
FIG. 11 is a view similar to FIG. 3 but illustrating a three position switch in accordance with the present invention.

FIGS. 11 and 12 illustrate an alternative embodiment of a high-voltage multiple position switch module, indicated generally at 130, constructed in accordance with the present invention. The high voltage switch module 130 is generally similar to the aforedescribed high voltage switch module 10 except that it includes a set of movable switch contacts that are movable between an open circuit condition and either of two different closed circuit conditions with stationary spring contacts. Elements of the high voltage switch 130 which are substantially identical to elements in the aforedescribed two position switch 10 are represented by primed reference numerals.

As illustrated in FIGS. 11 and 12, the high voltage switch 130 includes a housing support structure or frame 42' having upstanding laterally spaced sidewalls, one of which is indicated at 42'a, on the upper ends of which are mounted a fixed contact support member 44'a. A movable contact support member 44'b is supported by and between the upstanding sidewalls 42'a,b in a manner enabling fast-action or snap-action movement of movable contact blades, one of which is indicated at 48'a, between positions spaced from fixed spring contacts, one set of which is indicated at 46'a, mounted on the fixed support member 44'a and positions closed into the spring contacts 46'a–c through the operation of a snap-action switch actuator mechanism 102'.

The support frame of the high voltage switch 130 also supports a second fixed contact support member 44c which is identical to and interchangeable with the contact support members 44'a and 44'b. The contact support member 44c is supported by and between the side frame members 42'a,b by L-shaped brackets 132 which are affixed to the side frame members through bolts 134 and are attached to the opposite ends of support member 44c through bolts 136 received through the mounting pads (one of which is shown at 84'a in FIG. 11) on the contact support member 44c. The contact support member 44c supports three sets of fixed spring contacts 138 for cooperation with the movable contact blades 48'a–c to enable completion of a circuit from the service entrance conductors (not shown in FIGS. 11 and 12) connected to the movable contacts 48'a–c to a third service entrance (not shown) which may be termed a "future use" or emergency supply conductor. Alternatively, the system could enable connection from the service entrance conductors to ground terminals for safety purposes. The spring contact 138 for each phase of the switch module 130 is mounted on a contact support, indicated generally at 140, which includes a contact support bar 142 formed integral on a flexible stranded conductor cable 144.

Figure 13:
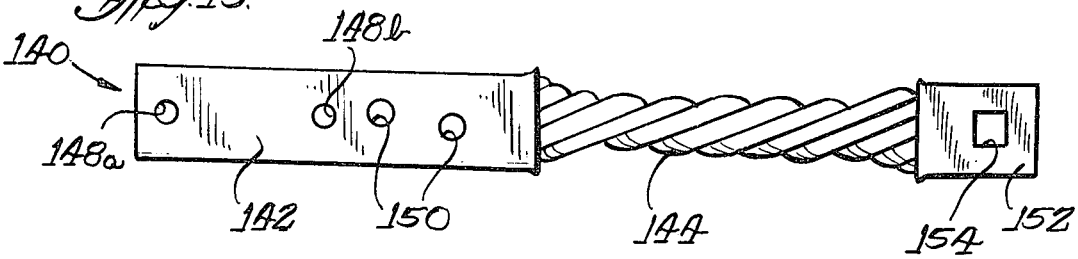
FIG. 13 is a side view of a contact bar employed in the three position switch of FIGS. 11 and 12.

Referring to FIG. 13, the contact support 140 is generally similar to the aforedescribed contact blades 48a–c in that the contact support bar 142 is formed by swaging a conductive sleeve onto one end of the flexible stranded conductive cable 144 with sufficient force to effect cold flow between the adjacent strands of the flexible cable 144 and between the strands and the conductive sleeve, thereby forming a contact support end which is substantially solid in transverse cross section. The contact support bar 142 has a pair of transverse cylindrical bores 148a and 148b formed therethrough to facilitate mounting of the contact support bar on the contact support member 44c. The contact support member 44c is adapted to enable mounting thereon of the contact support bar 142 for each phase of switch 130 in similar fashion to mounting of the contact blades 48a–c and spring contact support bars 52a–c, respectively, on the contact support members 44a,b. The contact support bar 142 of the contact support 140 has a second pair of cylindrical bores 150 formed therethrough to facilitate mounting of the spring contacts 138 thereon through suitable screws or bolts.

The end of the flexible conductor cable 144 opposite the contact support bar 142 has a connector end 152 formed by swaging a conductive sleeve onto the end of the stranded conductive cable 144 in similar fashion to forming of the end 122 on the aforedescribed conductive cable 110. The connector end 152 has a square hole 154 therethrough to enable electrical connection of the contact support and associated spring contact with a service terminal or bushing which, as aforenoted, may be employed as a "future use" or emergency supply conductor.

In swaging the conductive sleeves onto their respective conductor cables 110 and 144, it is preferred that the opposite ends of the conductor cables are first swaged prior to receiving the tubular conductive sleeves thereon so as to eliminate air space between the cabled conductive strands without substantially increasing the overall outer diameter dimension of the cable. The tubular conductive sleeves or contacts which are to form the contact and connector ends 112, 122, 142 and 152 are then placed on the opposite ends of the initially swaged cable conductor and are swaged thereon with sufficient force to effect cold flow between the strands and the conductive sleeves so as to form substantially unified solid contact and connector ends on the conductive cables. The cylindrical and square bores 118a,b 124, 148a,b, 150 and 154 are then formed in the solid contact and connector ends.

Thus, in accordance with the present invention, interchangeable nonconductive contact support members are provided which are interchangeable in a manner enabling use for support of movable contact blades or for use in supporting fixed conductive spring-type contacts on contact support bars. In accordance with a further feature of the invention, flexible conductor cables having conductive contact blades or contact support bars and associated connector ends thereon are provided which enable use as movable blade contacts or as conductive support bars for spring type electrical contacts, and which may be readily mounted on the nonconductive contact support members without need for bolt changes as have heretofore been required.

While preferred embodiments of the present invention have been illustrated and described, it will be understood that changes and modifications may be made therein without departing from the invention in its broader aspects. Various features of the invention are defined in the following claims.

What is claimed is:

1. In a high voltage type switch having a casing defining an internal chamber and having a plurality of service entrance terminals mounted on said casing, a multiposition switch mechanism mounted within said casing and including at least one electrically conductive contact support bar having a mounting portion and at least one electrically conductive contact blade having a mounting portion, electrical contact means mounted on said contact support bar, and support member means operatively associated with said conductive contact support bar and said conductive contact blade and operative to effect relative movement therebetween between positions wherein said contact blade is spaced from said electrical contact means and positions establishing electrical contact between said contact blade and said electrical contact means; the improvement wherein the mounting portion on said conductive contact blade and the mounting portion on said conductive contact support bar are substantially identically shaped, said support member means comprising first and second substantially identically shaped interchangeable nonconducting support members each of which is adapted for supporting cooperative relation with the mounting portion of either said conductive contact blade or said conductive contact bar; each of said interchangeable nonconducting support members including means for selectively mounting a plurality of said blade contacts or contact support bars thereon.

2. A high voltage switch as defined in claim 1 wherein each of said interchangeable nonconducting support members comprises a molded nonmetallic contact support member having a plurality of mounting pads equidistantly spaced along its longitudinal length, each of said mounting pads being adapted for releasable mounting of either said conductive contact blade or conductive contact support bar thereon.

3. A high voltage switch as defined in claim 2 wherein said multiposition switch mechanism includes a support frame, and wherein each of said contact support members has a pair of mounting flanges formed on its opposite ends enabling mounting of the contact support member in said pivotal relation on said support switch support frame.

4. A high voltage switch as defined in claim 3 including a fast-action switch transfer mechanism mounted on said switch housing and having means extending internally of said support frame to establish a transverse pivot axis, said mounting flanges on said contact support members being adapted for operative connection to said fast action switch transfer mechanism for rotation about said transverse axis.

5. A high voltage switch as defined in claim 2 wherein each of said contact support members has a generally planar barrier plate formed transversely thereof between each of said mounting pads, each of said generally planar barrier plates establishing barrier surfaces of sufficient area to substantially increase electrical surface length between said mounting pads.

6. A high voltage switch as defined in claim 5 wherein each of said mounting pads has an opening formed therein to receive a selected one of said contact blade or contact support bar therethrough, said contact blade and contact support bar each having a transverse pin therethrough, and each of said mounting pads having a pin receiving recess formed transversely of the major axis of said opening to receive the transverse pin in the corresponding contact blade or contact support bar when inserted within said opening.

7. A high voltage switch as defined in claim 2 wherein each of said mounting pads has an opening formed therethrough transverse to the longitudinal axis of the corresponding support member, each of said openings being configured to selectively receive either said contact blade or said contact support bar therethrough, and including means cooperative with the support member and associated contact blade or contact support bar to maintain the associated contact blade or support bar in mounted relation within said opening.

8. A high voltage switch as defined in claim 2 wherein said nonmetallic contact support members are made from a molded plastic material.

* * * * *